United States Patent [19]

Yose

[11] Patent Number: 4,752,664

[45] Date of Patent: Jun. 21, 1988

[54] MICROWAVE OVEN WITH A REMOVABLY ATTACHED HEATER

[75] Inventor: Toshio Yose, Yao, Japan

[73] Assignee: Sharp Kabushiki Kaisha, Osaka, Japan

[21] Appl. No.: 881,070

[22] Filed: Jul. 2, 1986

[30] Foreign Application Priority Data

Jul. 5, 1985 [JP] Japan ..... 60-103228[U]
Jul. 15, 1985 [JP] Japan ..... 60-108401[U]

[51] Int. Cl.[4] ..... H05B 6/64

[52] U.S. Cl. ..... 219/10.55 B; 219/10.55 E; 219/10.55 R; 219/357; 174/6; 338/276

[58] Field of Search ..... 219/10.55 B, 10.55 R, 219/10.55 D, 10.55 E, 357, 342; 174/35 R, 6, 206; 338/276, 233

[56] References Cited

U.S. PATENT DOCUMENTS

| | | | |
|---|---|---|---|
| 4,137,442 | 1/1979 | Tateda | 219/10.55 B |
| 4,191,877 | 3/1980 | Tanaka et al. | 219/10.55 B |
| 4,298,780 | 11/1981 | Suzuki | 219/10.55 D X |
| 4,477,706 | 10/1984 | Mittelsteadt | 219/10.55 B |
| 4,485,285 | 11/1984 | Machesney | 219/10.55 B |

*Primary Examiner*—Philip A. Leung
*Attorney, Agent, or Firm*—Flehr, Hohbach, Test, Albritton & Herbert

[57] ABSTRACT

A microwave oven with a removably attachable heater for convective heating has on its wall a compact socket member containing plate spring-like grounding pieces through which the outer cover of the heater can be reliably grounded through the oven wall. The heater may be provided with a position indicating insulator piece by means of which the user can visually ascertain that the heater is properly attached to the oven.

5 Claims, 4 Drawing Sheets

MICROWAVE OVEN WITH A REMOVABLY ATTACHED HEATER

This invention relates to a microwave oven with a heater and more particularly to a microwave heating device having a removably attached sheath heater inside its oven.

Figure 8:
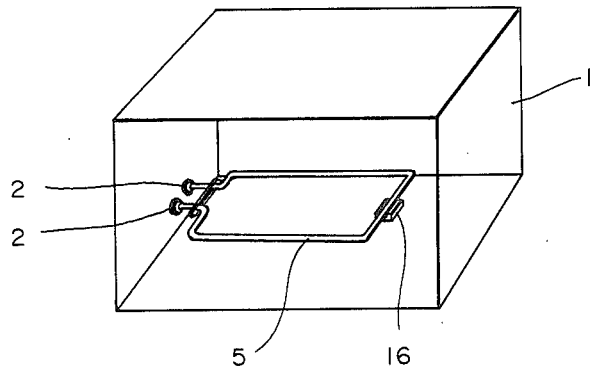
PRIOR ART FIG.—8

By a microwave oven with a heater is herein meant a heating device having both the micrwave heating function and the convective heating function. FIG. 8 shows an example of prior art heating device of this type, including a sheath heater 5 with both terminals inserted into openings 2 provided on a sidewall of an oven 1. In order to dependably insulate the sheath heater 5 from the bottom wall of the oven 1, an insulator 16 is provided on the bottom wall to support the sheath heater 5. An oven of this type is disadvantageous in that the insulator 16 makes it difficult to clean the bottom wall of the oven and also as to the overall cost of the product. When the sheath heater 5 is set in the holes 2, furthermore, the user cannot ascertain visually whether the sheath heater 5 has been correctly set and may feel uneasy while using the oven.

Figure 9:
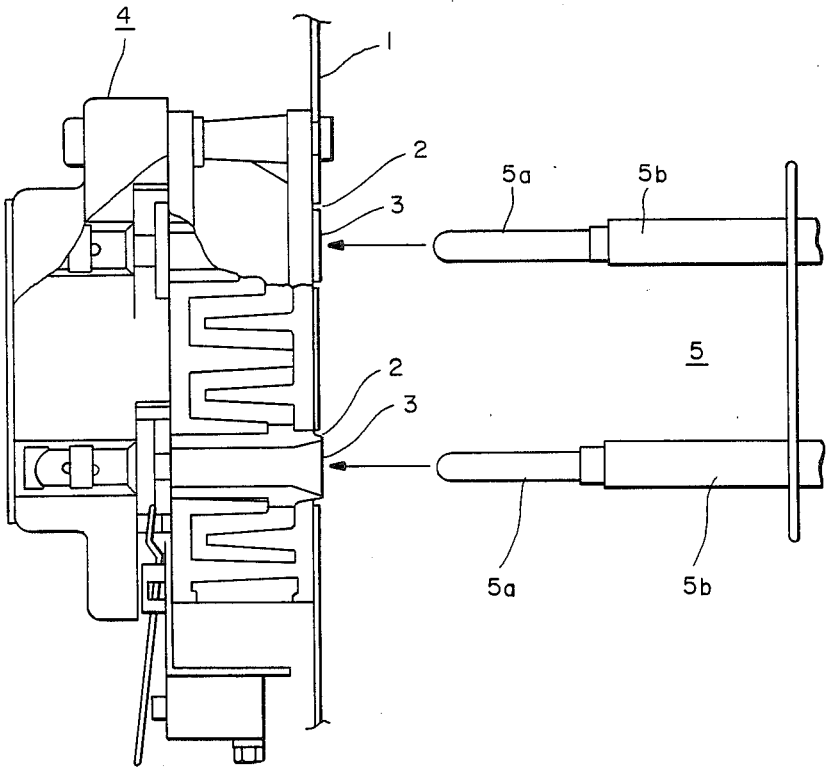
PRIOR ART FIG. — 9
Figure 10:
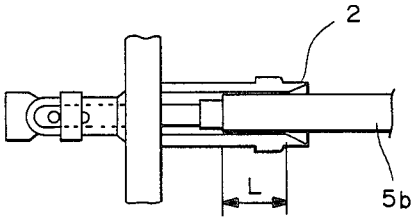
PRIOR ART FIG. — 10

FIG. 9 shows how the sheath heater 5 of FIG. 8 may be inserted into the openings 2. According to the example shown therein, there is provided a socket member 4 having metallic guide pieces 3 corresponding to and in coaxial relationships with the openings 2 in the sidewall of the oven 1. Only the leg section of the heater 5 adapted to be plugged into the openings 2 is shown in FIG. 9 wherein numeral 5*a* indicates heater terminals and numeral 5*b* indicates its outer cover. Each guide piece 3 is designed as shown in FIG. 10 such that when the heater 5 is plugged in, the gap between the inner surface of the tubular guide piece 3 and the outer surface of the cover 5*b* is reduced and the length L of the gap is increased, thereby reducing the amount of microwave energy which may propagate out of the oven. The socket member 4, in order to achieve these objectives, tends to be inconveniently bulky. Since the contact surfaces must be accurately formed to ensure dependable electrical contacts, furthermore, this also tends to increase the overall cost of its fabrication.

It is therefore an object of the present invention to provide a microwave oven with a heater which can be attached by means of a compact socket member.

It is another object of the present invention to provide a microwave oven with a heater which can be grounded reliably through its wall.

It is a further object of the present invention to provide a microwave oven with a sheath heater which can be positioned easily by the user.

The above and other objects of the present invention are achieved by providing a microwave oven with a removably attachable sheath heater by means of a socket member which is affixed to a wall of the oven. A plate spring-like grounding piece is contained in the socket member and serves to ground the outer cover of the heater. An insulating piece may be attached to the heater as a position indicator such that it will engage with an indentation provided in the bottom wall of the oven if the heater is correctly plugged in.

Figure 1:
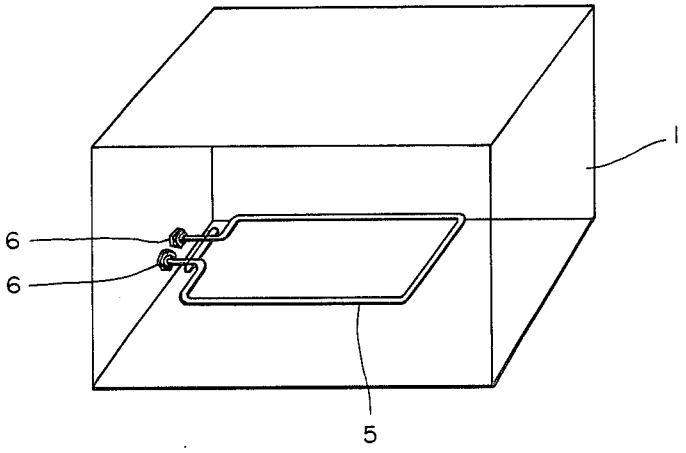
Figure 2:
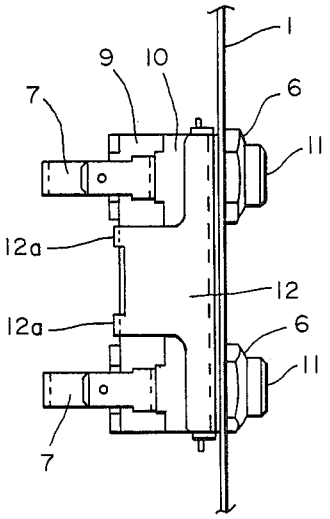
Figure 3:
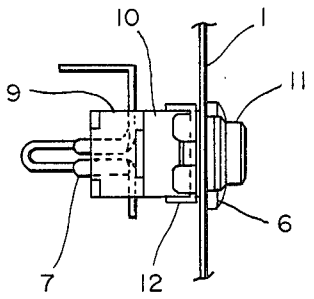
Figure 4:
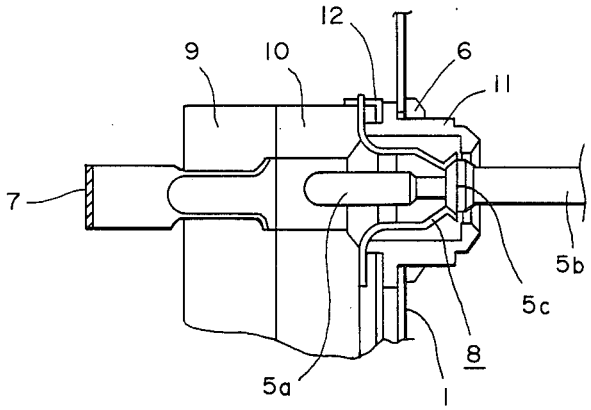
Figures 5A, 5B:
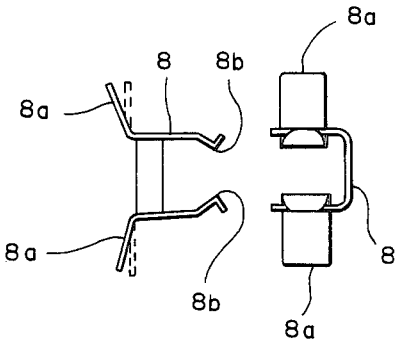
Figure 6:
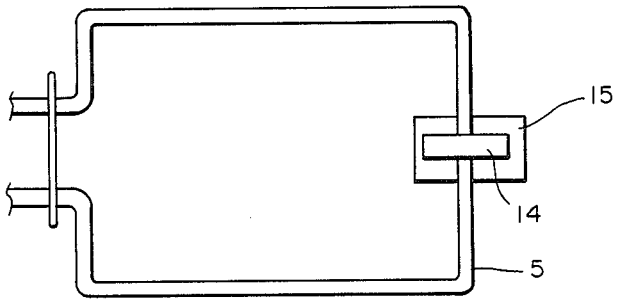
Figure 7:
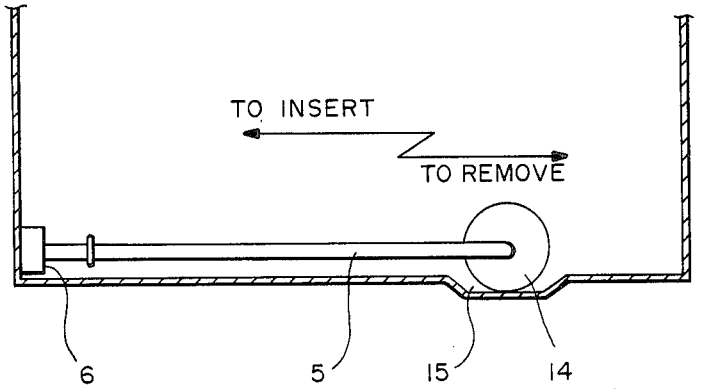

The accompanying drawings, which are incorporated in and form a part of the specification, illustrate embodiments of the present invention and, together with the description, serve to explain the principles of the invention. In the drawings:

FIG. 1 shows how a heater may appear when it is attached to a microwave oven according to the present invention, FIG. 2 is a top view of a heater socket member embodying the present invention attached to the sidewall of an oven, FIG. 3 is a front view of the heater socket member of FIG. 2, FIG. 4 is a horizontal sectional view showing how a heater is set in the socket member of FIGS. 2 and 3, FIGS. 5-A and 5-B are respectively a front and a right-hand side view of a grounding piece embodying the present invention, FIG. 6 is a top view of a sheath heater embodying the present invention, FIG. 7 is a horizontal sectional view of a bottom part of a microwave oven with the sheath heater of FIG. 6, FIG. 8 shows how a heater may be attached to a prior art microwave oven, FIG. 9 is a top view of a prior art socket member for removably attaching a heater to an oven wall, and FIG. 10 is a horizontal sectional view of the prior art socket member of FIG. 9 with a heater terminal inserted therein.

In FIG. 1 which schematically shows how a heater may be set in a microwave oven according to the present invention, numeral 1 indicates a microwave oven or a wall thereof, numeral 5 indicates a heater of which terminal sections are formed as shown in FIG. 9 and numerals 6 indicate nuts which serve to fasten the heater 5 to the oven 1. A heater socket member (not shown in FIG. 1) into which the heater 5 is adapted to be plugged is illustrated in FIGS. 2 and 3 and its structure is explained below by way of FIG. 4. Corresponding components in these figures are indicated by the same numerals defined above.

As shown in FIGS. 2-4, the heater socket member according to the present invention comprises socket terminals 7 which are connected to a power source and into which the heater terminals 5*a* are intended to be inserted, plate spring-like grounding pieces 8 each adapted to elastically compress the contact piece 5*b* of the heater 5 when the latter is inserted thereinto, casings 9 and 10 made of an insulative material, metallic guide pieces 11 in a cylindrical tubular form and a metallic supporting plate 12 for supporting all the components mentioned above. Each of the aforementioned grounding pieces 8 is unistructural and made of a conductive material shown by solid lines in FIG. 5 when there is no external force applied thereon. Numerals 8*a* and 8*b* respectively indicate leg pieces and front clips to be explained more in detail below. Each grounding piece 8 is placed between the guide piece 11 which is secured to the supporting plate 12 and the casing 10. The supporting plate 12 is provided with claws 12*a* and is thereby fastened to the casing 9 such that the leg pieces 8*a* are elastically deformed as shown by dotted lines in FIG. 5 and compressed against the guide piece 11 to provide a secure electrical contact therewith.

At the edge of the outer cover 5*b* towards the corresponding terminal 5*a*, there is an insulative ring 5*c* of a slidable resin material which is shaped as shown in FIG. 4 such that the heater terminal 5*a* can be inserted into the socket terminal 7 with a single push with sufficient force to simultaneously cause the ring 5*c* to pass through the front clips 8*b* of the grounding piece 8. The socket terminal 7 has a sharply curved section as shown in FIG. 3. The radius of curvature of this section should preferably be made as large as practicable so that this piece will have a long lifetime as the heater 5 may be frequently inserted into it and removed from it.

Structured as described above, the heater socket member embodying the present invention can be made much thinner and more compact than the prior art socket members designed for the same purpose because the grounding pieces 8 are made to securely contact the outer cover 5*b* of the heater 5 and hence are reliably grounded through the guide pieces 11, nuts 6 and the oven 1.

According to another embodiment of the present invention illustrated in FIGS. 6 and 7 wherein the numerals used above indicate corresponding components, a disk-shaped insulator 14 is mounted to the heater 5 and an indentation 15 is provided to the bottom wall of the oven 1 such that the insulator 14 will engage with the indentation 15 as shown in FIG. 7 and the user, by checking whether the unsulator 5 is at the position of the indentation 15, can visually determine that the heater 5 has been properly plugged in.

The foregoing description of preferred embodiments of the invention has been presented for purposes of illustration and description. It is not intended to be exhaustive or to limit the invention to the precise form disclosed, and obviously many modifications and variations are possible in light of the above teaching. For example, the indentation 15 on the bottom wall of the oven 1 for positioning the heater 5 properly may be replaced by a protrusion. Likewise, a part of the heater 5 may be bent locally to be used as a position indicator instead of the disk-shaped insulator 14 shown in FIGS. 6 and 7. Such modifications and variations that may be apparent to a person skilled in the art are intended to be included within the scope of this invention.

What is claimed is:

1. A microwave oven with microwave generating means and a removably attachable heater comprising an oven wall, a heater with an outer cover, a socket member affixed to said oven wall, and a plate spring-like grounding piece which is contained in said socket member and is adapted to be elastically compressed against said outer cover of said heater to ground said outer cover through said oven wall when said heater is received by said socket member.

2. The microwave oven of claim 1 wherein said socket member penetrates said oven wall.

3. The microwave oven of claim 1 wherein said grounding piece is elastically compressed against a part of said socket member where said socket member penetrates said oven wall.

4. The microwave oven of claim 1 wherein said socket member defines a direction along which a portion of said heater is intended to be inserted thereinto for electrical connection.

5. The microwave oven of claim 4 wherein said grouding piece has a contact surface which is oblique to said direction and is adapted to be elastically compressed against said outer cover.

* * * * *